United States Patent [19]

Jackson

[11] Patent Number: 4,787,557

[45] Date of Patent: Nov. 29, 1988

[54] SOLID SET SPIKE IRRIGATION HEAD CONNECTING DEVICE

[76] Inventor: Miles E. Jackson, R.D. #4, Box 304, Elmer, N.J. 08318

[21] Appl. No.: 144,062

[22] Filed: Jan. 15, 1988

[51] Int. Cl.[4] ..... B05B 15/06

[52] U.S. Cl. ..... 239/200; 239/273

[58] Field of Search ..... 239/273, 276, 285, 200, 239/201, 208; 52/166, 743; 285/61

[56] References Cited

U.S. PATENT DOCUMENTS

| | | | |
|---|---|---|---|
| 843,585 | 2/1907 | Cole | 239/280 |
| 1,949,904 | 3/1934 | Guedel | 299/111 |
| 2,187,324 | 1/1940 | Many | 72/107 |
| 2,631,062 | 3/1953 | Tiedemann et al. | 299/75 |
| 2,852,307 | 9/1958 | Clark | 299/72 |
| 2,999,644 | 9/1961 | Nobinger | 239/229 |
| 3,105,510 | 10/1963 | Demosthenes | 239/276 |
| 3,193,205 | 7/1965 | Hanson | 239/276 |
| 3,387,785 | 6/1968 | Jaggers | 239/273 |
| 3,542,294 | 11/1970 | Tucker | 239/201 |
| 3,662,956 | 5/1972 | Hedman | 239/201 |
| 3,798,867 | 3/1974 | Starling | 52/743 |
| 4,371,113 | 2/1983 | Ross | 239/201 |

*Primary Examiner*—Andres Kashnikow
*Assistant Examiner*—Karen B. Merritt
*Attorney, Agent, or Firm*—Thomas A. Lennox

[57] ABSTRACT

A solid set spike irrigation head connecting device constructed of a PVC housing pipe filled with concrete encapsulating a vertical connection pipe that extends out the top and is bent at about a 45 degree angle to extend out through the housing about a foot from the top of the housing toward lateral irrigation pipe to provide a durable, cleanable, drainable, stress-free connection.

15 Claims, 2 Drawing Sheets

SOLID SET SPIKE IRRIGATION HEAD CONNECTING DEVICE

BACKGROUND OF THE INVENTION

This invention involves a solid set spike irrigation head connection device to be used in irrigation fields to water crops to support and connect to risers holding sprinkler heads and connecting at the oppposite end to lateral pipes of the irrigation field.

In many climates and for numerous crops, it is necessary to irrigate the fields either regularly or in times of unsatisfactory rain fall. An example of such crops are blueberry fields which are planted in rows usually about six to twelve feet apart. There is some space between branches of adjoining bushes along the row, but as the bushes mature, adjoining plants almost touch each other. Typical irrigation fields provide water from the source controlled by eight inch gate valves along a main line that varies in pipe diameter from about eight inches down to two inches as the distance increases from the source. Lateral pipe connections are attached to the main lines which are laid down between every seven rows of blueberry bushes as the sprinkler heads cover a radius of about 55 to 60 feet. These lateral pipe lines usually vary in diameter from about three inches to about one and a half inches and extend almost the entire length of the rows. Connected in both directions from these lateral lines are connecting lines branch off toward the line of bushes to a position between the bushes at which point connection is made to traditional spike devices. The purpose of these devices is to provide a quick connect and disconnect to a riser pipe which supports and feeds a sprinkling head at a height suitable to irrigate the particular crops. For blueberries, the riser is typically about five or six foot in height with a standard sprinkling head connected at the top. At the bottom of this pipe riser, is a quick connect/disconnect device allowing the sprinkler heads to be moved from section to section in the fields. The traditional spike 10 is illustrated in FIG. 1. Spike 10 includes one inch metal pipe 12 at the top of which is connected female quick disconnect device 14. At the bottom of pipe 12 is connected 90 degree t-connector 16 to which at its bottom is connected solid steel one inch rod 18 which extends well into subsoil 20. To the horizontal thread connector of t-connector 16 is attached vinyl connector pipe 22 which is connected directly to a lateral of the irrigation system. Sprinkler pipe riser 24 is connected through male quick disconnect device 26 into female quick disconnect device 14 and is held vertically to position sprinkler head 28 above the level of the bushes to be irrigated.

The irrigation head spike is subjected to substantial stress during use. The necessity of a five to six foot pipe riser causes the sprinkling head movement to exert a substantial torque on the spike. Even though the spike is solid steel and is embedded up to three feet in the ground, it is rare that spike is not almost immediately loosened in its hole such that the entire spike system wobbles around, back and forth during the sprinkling operation. Typically, that "working" provides for an uneven set such that the sprinkler head riser is angled to a sufficient degree to inefficiently cover the area for which it was intended. It does not take much of an angle downwardly for the sprinkler head to suffer a considerable decrease in area coverage. This is particularly true when the bushes are mature and in relatively close proximity to the head. In addition to the unevenness and inefficiency caused by angling of the spike, the loosening in the soil is detrimental to the like of the spike. Since the earth around the spike is opened up, water immediately enters the area around the spike to facilitate corrosion. Although it is desired to achieve at least twenty years of like from an irrigation field, it is not uncommon to find the one inch diameter solid steel spike almost completely corroded away after only five years in the field. The corrosion rate is affected by the acid content of the soil and the drainage capabilities of the subsoil.

Even in moderate climates, such as in New Jersey where a substantial portion of the blueberries are grown, freezing penetrates a substantial depth into the ground. As a result, if the lateral pipes are not of a sufficient depth, recommended at about 23 to 28 inches from ground level, there will be a substantial freeze problem. Freezing can rupture and damage the entire irrigation system. Further, of necessity the spikes reach to above ground level. The lateral pipe connection to the spike is usually about one foot from the ground level. It is common for water to remain at the 90 degree angle fitting which can cause freezing and breakage problems. In addition, the angle of the connection from the spike, being in 90 degrees, requires the connecting pipe connection to bend substantially downwardly to reach the lateral pipe at 23 to 28 inches in depth. Although the typical plastic polymeric pipe is sufficiently flexible to bend, a substantial strain is placed at the connection and breakage is common.

None of the prior art devices satisfy the above needs and deficiencies and achieve the objects described herein below.

SUMMARY OF THE INVENTION

The invention includes an irrigation head support spike and pipe connection device including a pipe of a length sufficient to extend from a top above ground level to a bottom at a depth below ground level suitable for connection to an irrigation lateral pipe. The invention also includes a quick disconnect connection device attached to the top of the pipe to allow easy connection and disconnection of a sprinkler head means to deliver and distribute water in a fashion and at a height suitable to irrigate crops. The pipe has a preferred angle bend sufficient to angle the bottom of the pipe at about a 35 degree to about a 55 degree angle from the horizontal and an attachment device, preferably threadable, on the bottom end of the pipe to attach with the irrigation lateral pipe. The invention further includes a cementous composition encasement and spike integral mass encapsulating the pie with the top of the pipe extending out of a top of the encasement and the bottom of the pipe extending out a side of the encasement, the length of the encasement and spike being sufficient to extend downwardly to a depth wherein operation of the irrigation means cannot significantly move the spike. The invention also includes an irrigation head support and pipe connection device including a housing having an open top and a bottom in a pipe with a top end and a bottom end, the pipe being positioned inside the housing of a length sufficient for the top end of the pipe to extend out the open top of the housing, the pipe having a bend sufficient to angle the bottom of the pipe out a side of the housing at about a preferred 45 degree angle from the horizontal. This embodiment of the invention includes a quick disconnect device attached to the top of the pipe to allow easy connection and disconnection of a sprinkler head means to deliver and distribute water in a fashion and at a height suitable to irrigate crops. This embodiment further includes a cementous composition filling the housing from top to bottom and encapsulating the pipe, the length of the filling housing being sufficient to extend downwardly to a depth wherein operation of the irrigation device cannot significantly move the bottom of the housing.

The bend in the pipe is a sufficient angle from the horizontal to allow full drainage into the connecting pipe and positioning the pipe to fully drain into the lateral pipe of the irrigation system. The angle of the bend in the pipe is also sufficient to allow cleaning of the pipe set device through the top of the pipe and the connect/disconnect device. Cleaning may be accomplished with a wire or a snake which will enter from the top and turn the corner at the bend into the connecting pipe toward the lateral pipe system. The bend in the pipe is angled from the vertical sufficient to allow connection to the connecting pipe and positioning the connecting pipe at an angle so that it drains properly and can easily connect to the lateral pipe system with little or no bend. The connecting pipe is typically one inch polyolefin or polyvinyl chloride pipe which is sufficiently flexible to bend in an arc within the variances caused in the depth of the lateral pipes. The one inch connecting pipe is commonly supplied in large rolls so that a permanent bend is placed in the pipe. To place the minimum strain on the curved connecting pipe the preferred bend in the pipe in the device varies from about 20 degrees to about 55 degrees from the horizontal. It is more preferred that the pipe connection angling out of the set device of this invention be in the range of 35 to 55 degrees. It is most preferred that the angle be about 45 degrees. The preferred angle is that angle that will position connection of the bottom of the pipe in the device to the connecting pipe at an angle generally directed toward the lateral irrigation pipe such that there is little or no bending of the connection pipe necessary to effect the connection. The preferred length of the spike and head connection device is about 30 to about 40 inches and it is preferred that the position of the bottom of the pipe connection angling out the side of the encasement be about one foot from the top of the device. It is preferred to about six to eighteen inches from the top.

DESCRIPTION OF PREFERRED EMBODIMENTS

Figure 1:
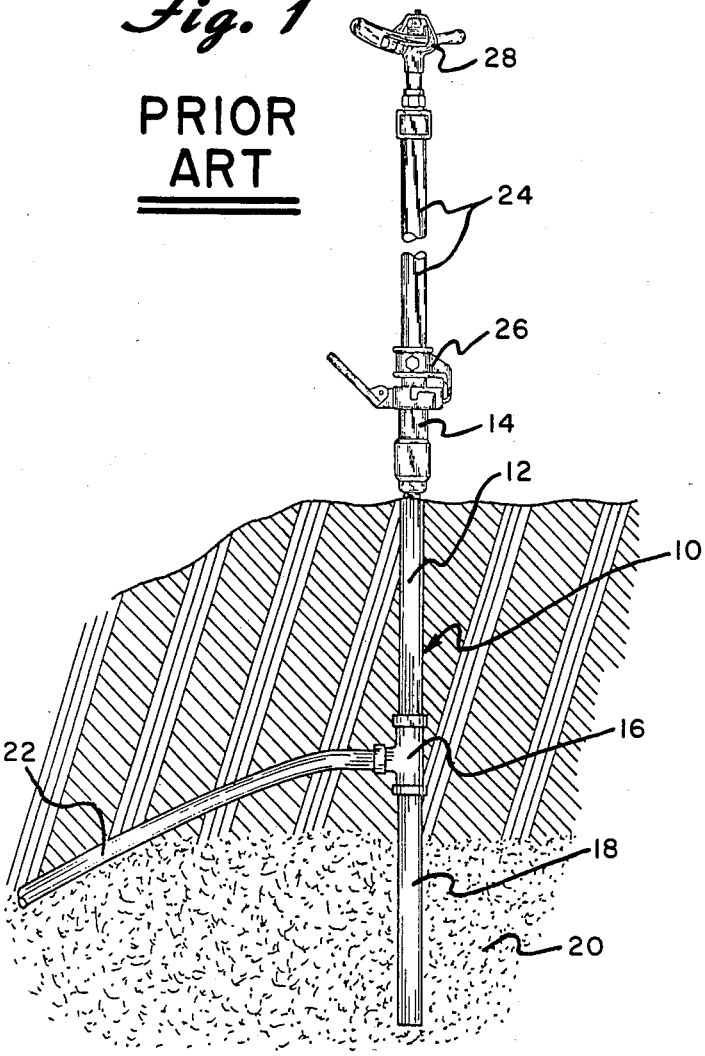
Fig. 1 PRIOR ART
FIG. 1 is a perspective view of a traditional irrigation head connecting device and spike.
Figure 2:
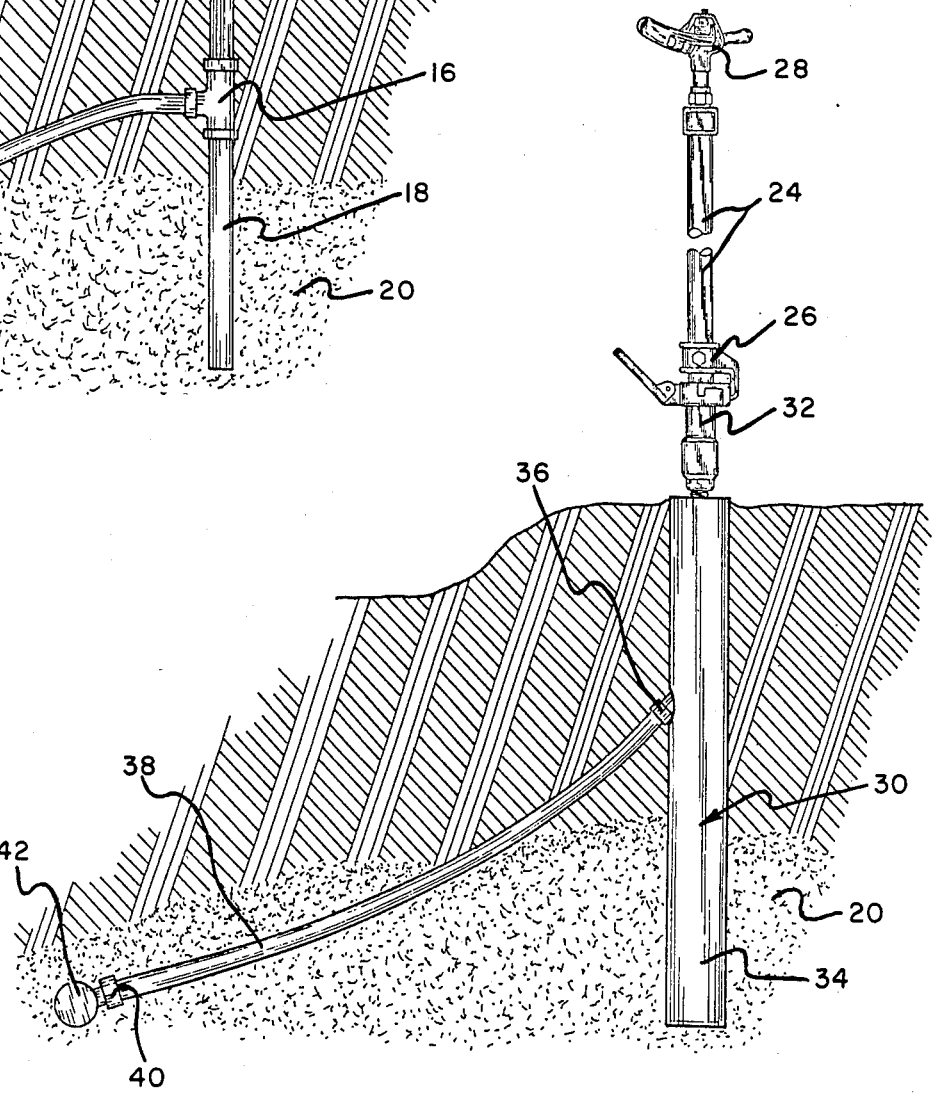
FIG. 2 is a perspective view illustrating connection of an irrigation head connecting device and spike of the present invention to an irrigation lateral pipe.
Figure 3:
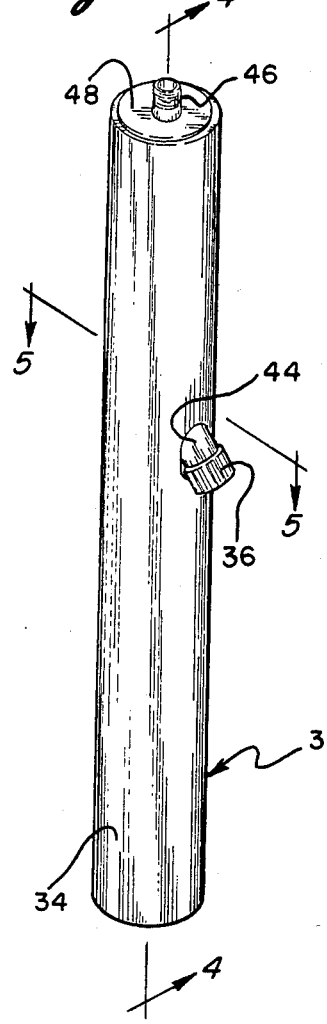
FIG. 3 is a perspective view of an irrigation head connecting device and spike of the present invention.
Figure 4:
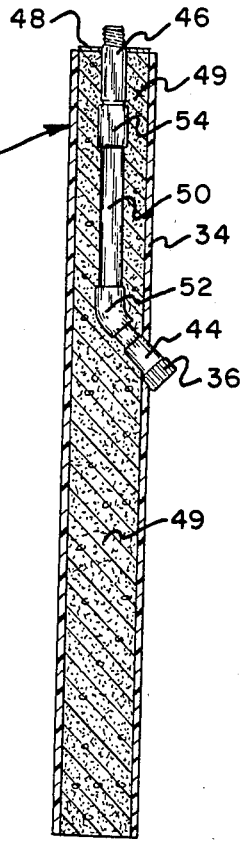
FIG. 4 is a cross-sectional view taken along lines 4—4 of FIG. 3.
Figure 6:
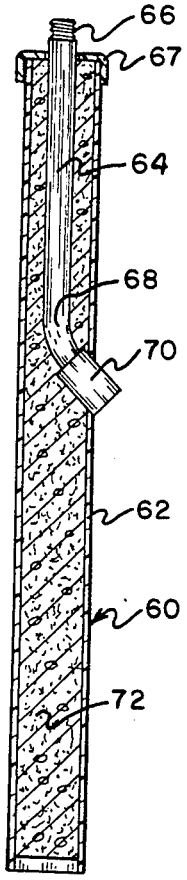
FIG. 6 is a vertical cross-sectional view of a second embodiment of the present invention.
Figure 5:
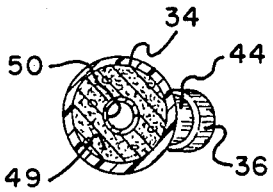
FIG. 5 is a cross-sectional view taken along lines 5—5 of FIG. 3.

In FIG. 2, the solid set spike irrigation head connecting device 30 of the present invention is shown buried into soil 20. Externally, spike 30 is a three inch diameter vinyl pipe from which pipe connector 36 extends angled downwardly toward two inch lateral irrigation pipe 42 equipped with one inch connector 40. Standard one inch polyvinyl chloride polymer connecting pipe 38 is joined to connector 36 at one end and to connector 40 at the other end to provide free water flow from the lateral through connector 36 to the interior of spike 30. At the top of spike 30 is female quick disconnect 32 into which male quick disconnect 26 attached to riser 24 holding sprinkler head 28 at the proper height is connected. In FIG. 3, set spike 30 of the present invention is illustrated showing three inch vinyl pipe 34 as the exterior surface encasement with connector 36 angled downwardly from angled pipe 44 extending outwardly from the interior of encasement pipe 34 at a position intermediate along the length of pipe 34 which is about 30 inches in length. Preferably, angled pipe 44 extends out through the side of pipe 34 at about one foot from the top of encasement pipe 34. Vertical pipe 46 extends outwardly through the top end of pipe 34 and is threaded to engage female quick disconnect device 32. Concrete 49 fills the entire interior of pipe 34 and encapsulates all interior components of set 30. Epoxy resin seal 48 seals the top of concrete 49 and pipe 34 to prevent water intrusion into the joint interface. In FIG. 4, the cross sectional view shows the internal construction of spike set 30. Vertical pipe 46 extends downwardly and may include connection 54 to extend vertical pipe length 50 which connects at its lower end to 45 degree angled connector 52 which positions angled pipe 44 so that it extends outwardly through the side wall of encasement pipe 34 at a 45 degree angle. In FIG. 5, the horizontal cross-sectional view positions pipe 50 in the center of the concrete encapsulation 49 inside pipe 34. In FIG. 6, another embodiment, set device 60 is illustrated in a vertical cross-sectional view taken in the same general fashion as FIG. 4. Set device 60 includes three inch PVC pipe 62 and vertical interior pipe 64 which extends outwardly past the upper end of pipe 62 about one and a half inches with the upper end fixed to connecting device 66 which interconnects with a standard female quick disconnect device. Pipe 64 is angled at lower section 68 at about 35 degrees from the horizontal to extend out through the wall of housing pipe 62. Connection sleeve 70 is adhesively attached to one inch polyolefin pipe 64 below bend 68 and extends out through the vertical wall of housing pipe 62 opening downwardly at about a 35 degree angle from the horizontal to connect with a connecting pipe directly to the lateral. At this angle, when the lateral pipe is buried at a depth of about 23 to 28 inches there is little or no bend required of the connecting one inch polyolefin pipe. Typically, the top of the set spike is at or slightly above the ground level between the bushes and the ground level at that position is usually about six inches higher than the ground level between the rows at the position below which the lateral pipe is buried. Concrete 72 fills the entire length of pipe 62 and encapsulates pipe 64 and connector 70. Plastic PVC polymer cap 67 seals around pipe end 66 and the top of housing pipe 62 from water intrusion. The term "concrete" is used throughout the specification and includes all cementous compositions including cement mix, gravel mix, sand mix, concrete and like compositions.

While this invention has been described with reference to the specific embodiments disclosed herein, it is not confined to the details set forth and the patent is intended to include modifications and changes which may come within and extend from the following claims.

I claim:

1. An irrigation head support and pipe connection device comprising:

(a) a pipe of a length sufficient to extend from a top proximate ground level to a bottom at a depth below ground level suitable for connection to an irrigation lateral pipe, (b) a quick disconnect connection means attached to the top of the pipe to allow easy connection and disconnection of a sprinkler head means to deliver and distribute water in a fashion and at a height suitable to irrigate crops, (c) a cementous composition encasement and spike integral mass encapsulating the pipe with the top of the pipe extending out of a top of the encasement and the bottom of the pipe extending out a side of the encasement, the length of the encasement and spike being sufficient to extend downwardly to a depth wherein operation of the sprinkler head means cannot significantly move the spike, (d) an angle bend in the pipe sufficient to angle the bottom of the pipe to:

(i) extend the pipe out a side of the encasement at an intermediate position along the length of the encasement, (ii) allow a cleaning means inserted downwardly through the top of the pipe to turn the bend to clean the pipe and the connection pipe, (iii) to angle in the direction of the lateral pipe so that there is little or no bending necessary in the connection pipe, and (iv) cause essentially full drainage of any water from the bend into the connection pipe to the lateral pipe, and (e) an attachment means on the bottom end of the pipe to attach with the irrigation connection pipe.

2. The device of claim 1 wherein the encasement fills a housing in the shape of a cylindrical tube.

3. The device of claim 2 wherein the tube is a polymeric plastic tube.

4. The device of claim 3 wherein the tube is a polyvinyl chloride polymer pipe having a diameter of about three inches.

5. The device of claim 1 wherein the pipe is a one inch polyvinyl chloride polymer pipe.

6. The device of claim 1 wherein the length of the pipe is sufficient to position the bottom of the pipe at about one foot from the top of the encasement.

7. The device of claim 1 wherein the angle of the bend is about 35 degrees to about 55 degrees.

8. The device of claim 1 wherein the angle is about 45 degrees.

9. The device of claim 1 wherein the cementous composition is concrete.

10. The device of claim 1 wherein the length of the encasement and spike is about 30 to about 40 inches in length.

11. An irrigation head support and pipe connection device comprising:

(a) a housing having an open top and a bottom, (b) a pipe with a top end and a bottom end, the pipe being positioned inside the housing of a length sufficient for the top end of the pipe to extend out the open top of the housing, the pipe having a bend sufficient to angle the bottom of the pipe out a side of the housing, (c) a quick disconnect connection means attached to the top of the pipe to allow easy connection and disconnection of a sprinkler head means to deliver and distribute water in a fashion and at a height suitable to irrigate crops, (d) an attachment means on the bottom end of the pipe to attach with an irrigation connection pipe, and (e) a cementous composition filling the housing from top to bottom and encapsulating the pipe, the length of the filled housing being sufficient to extend downwardly to a depth wherein operation of the irrigation means cannot significantly move the bottom of the housing, wherein the angle of the bend is sufficient to:

(i) extend the pipe out a side of the housing of an intermediate position along the length of the housing, (ii) allow a cleaning means inserted downwardly through the top of the pipe to turn the bend to clean the pipe and the connection pipe, (iii) to angle in the direction of a lateral irrigation pipe so that there is little or no bending necessary in the connection pipe to allow it to connect to the lateral pipe, and (iv) cause essentially full drainage of any water from the bend into the connection pipe to the lateral pipe.

12. An irrigation head support and pipe connection device comprising:

(a) a pipe of a length sufficient to extend from a top proximate ground level to a bottom at a depth below ground level suitable for connection to a connection pipe to an irrigation lateral pipe, (b) a quick disconnect connection means attached to the top of the pipe to allow easy connection and disconnection of a sprinkler head means to deliver and distribute water in a fashion and at a height suitable to irrigate crops, (c) an angle bend in the pipe sufficient to angle the bottom of the pipe at about a 20 degree to about a 55 degree angle from the horizontal, (d) an attachment means on the bottom end of the pipe to attach with the irrigation connection pipe, and (e) a cementous composition encasement and spike integral mass encapsulating the pipe with the top of the pipe extending out of a top of the encasement and the bottom of the pipe extending out a side of the encasement, the length of the encasement and spike being sufficient to extend downwardly to a depth wherein operation of the sprinkler bead means cannot significantly move the spike.

13. An irrigation head support and pipe connection device comprising:

(a) a housing having an open top and a bottom, (b) a pipe with a top end and a bottom end, the pipe being positioned inside the housing of a length sufficient for the top end of the pipe to extend out the open top of the housing, the pipe having a bend sufficient to angle the bottom of the pipe out a side of the housing at about a 45 degree angle from the horizontal, (c) a quick disconnect connection means attached to the top of the pipe to allow easy connection and disconnection of a sprinkler head means to deliver and distribute water in a fashion and at a height suitable to irrigate crops, (d) a threadable attachment means on the bottom end of the pipe to threadably attach with an irrigation connection pipe, and (e) a cementous composition filling the housing from top to bottom and encapsulating the pipe, the length of the filled housing being sufficient to extend downwardly to a depth wherein operation of the sprinkler head means cannot significantly move the bottom of the housing.

14. The device of claim 13 wherein the housing is a polyvinyl chloride polymer pipe having a diameter of about three inches.

15. The device of claim 1 wherein the length cementous filled housing is about 30 to about 40 inches in length.

* * * * *